US008807011B2

(12) United States Patent
Langevin

(10) Patent No.: US 8,807,011 B2
(45) **Date of Patent: *Aug. 19, 2014**

(54) FIREARM HAVING A DIRECT GAS IMPINGEMENT OPERATING SYSTEM

(75) Inventor: Kevin Langevin, Berlin, CT (US)

(73) Assignee: Colt Defense, LLC, West Hartford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/589,591

(22) Filed: Aug. 20, 2012

(65) Prior Publication Data

US 2014/0075740 A1 Mar. 20, 2014

Related U.S. Application Data

(62) Division of application No. 12/557,815, filed on Sep. 11, 2009, now Pat. No. 8,245,626.

(60) Provisional application No. 61/096,710, filed on Sep. 12, 2008.

(51) Int. Cl.
*F41A 5/28* (2006.01)

(52) U.S. Cl.
USPC ..... 89/193

(58) Field of Classification Search
USPC ..... 89/191.01, 191.02, 192, 193
See application file for complete search history.

(56) References Cited

U.S. PATENT DOCUMENTS

| | | | | |
|---|---|---|---|---|
| 696,306 | A | 3/1902 | Benet | |
| 804,986 | A | 11/1905 | Stamm | |
| 1,802,816 | A | 4/1931 | Holek | |
| 2,393,627 | A | 1/1946 | Garand | |
| 2,462,119 | A | 6/1946 | Moore | |
| 2,771,819 | A | 11/1956 | Morse et al. | |
| 2,887,013 | A | 5/1959 | Marsh | |
| 2,987,967 | A | 6/1961 | Wild et al. | |
| 4,244,273 | A | 1/1981 | Langendorfer, Jr. et al. | |
| 4,765,224 | A | 8/1988 | Morris | |
| 5,726,377 | A * | 3/1998 | Harris et al. | 89/191.01 |
| 5,827,992 | A | 10/1998 | Harris et al. | |
| 8,210,089 | B2 * | 7/2012 | Brown | 89/191.02 |

(Continued)

FOREIGN PATENT DOCUMENTS

GB 2237363 A 5/1991

OTHER PUBLICATIONS

Supplementary Partial European Search Report for PCT/US2009056625; Dated Jan. 20, 2014.

*Primary Examiner* — Bret Hayes

(74) *Attorney, Agent, or Firm* — Cantor Colburn LLP

(57) ABSTRACT

A method of removably securing a gas regulating sleeve and a gas line to a rifle by: fluidly coupling a gas block to a bore of a barrel of the rifle; removably locating and securing the gas regulating sleeve in the gas block, the gas line being in fluid communication with the bore via the gas regulating sleeve, and wherein a portion of the gas line is received within an impingement cylinder of a bolt assembly of the rifle when it is in a first position, and wherein the impingement cylinder moves away from the gas line as it moves from the first position to a second position due to gases from the gas block; and wherein the gas regulating sleeve and the gas line are removable from the gas block without disconnecting the barrel from the receiver and without removal of the gas block from the barrel.

12 Claims, 10 Drawing Sheets

(56) References Cited

U.S. PATENT DOCUMENTS

| | | | | |
|---|---|---|---|---|
| 8,245,626 | B2 * | 8/2012 | Langevin | 89/193 |
| 2007/0033851 | A1 | 2/2007 | Hochstrate et al. | |
| 2007/0199435 | A1 | 8/2007 | Hochstrate et al. | |
| 2010/0000400 | A1 * | 1/2010 | Brown | 89/191.01 |
| 2010/0275770 | A1 | 11/2010 | Noveske | |
| 2012/0132068 | A1 * | 5/2012 | Kucynko | 89/191.01 |
| 2012/0152106 | A1 * | 6/2012 | Langevin | 89/193 |
| 2012/0167757 | A1 * | 7/2012 | Gomez | 89/193 |

* cited by examiner

FIREARM HAVING A DIRECT GAS IMPINGEMENT OPERATING SYSTEM

CROSS-REFERENCED TO RELATED APPLICATION

This application is a divisional of U.S. patent application Ser. No. 12/557,815 filed Sep. 11, 2009, which claims the benefit of U.S. Provisional Patent Application Ser. No. 61/096,710 filed Sep. 12, 2008 the contents each of which are incorporated herein by reference thereto.

BACKGROUND

The disclosed embodiments relate to firearms and, more particularly, to a firearm having a direct gas impingement operating system.

There are conventional semi-automatic or automatic firearms that are gas operated via a gas tube or operating rod in the case of an indirect gas operating system. In each case, gas ports are provided that can become fouled, for example, with carbon buildup or may suffer erosion over time with firing. As such, there is a desire to eliminate or clear such variances in gas ports that may adversely affect operation of the firearm.

SUMMARY

In accordance with one exemplary embodiment, a direct gas impingement operating system for an automatic or semi-automatic rifle having a barrel connected to a receiver is provided. The direct gas impingement operating system has a gas block fitted to the barrel, the gas block in communication with a bore in the barrel. A gas regulating sleeve removably is provided located in the gas block, the gas sleeve in communication with the bore through the gas block. A bolt assembly is provided having an integral impingement cylinder and a gas line is fixed to the sleeve in fluid communication with the bore through the sleeve and the gas block, the gas line further in fluid communication with the impingement cylinder. Gas discharged from a fired cartridge displaces the impingement cylinder displacing the bolt assembly relative to the receiver. The sleeve and the gas line are removable from the gas block without disconnecting the barrel and receiver and without removal of the gas block from the barrel.

In accordance with another exemplary an automatic or semi-automatic rifle is provided. The automatic or semi-automatic rifle has a receiver and a bolt carrier having an impingement cylinder, the bolt carrier and impingement cylinder being enclosed within the receiver. A barrel is provided having a bore, the barrel coupled to the receiver. A gas block is fixed to the barrel, the gas block in communication with the bore. A gas sleeve is removably located in the gas block in communication with the bore. A gas line is provided fixed to the sleeve fluid in communication with the bore through the sleeve and the gas block, the gas line further in fluid communication with the impingement cylinder. Gas discharged from a fired cartridge displaces the impingement cylinder displacing the bolt carrier relative to the receiver. The sleeve is configured so that it defines a gas flow regulator regulating gas flow volume through the bore and is removable from the gas block without removal of the gas block from the barrel and without removal of the barrel from the receiver.

In accordance with another exemplary embodiment, a black rifle type automatic or semi-automatic rifle is provided. The black rifle type automatic or semi-automatic rifle has a receiver assembly enclosing a bolt carrier and a barrel assembly having a bore, the barrel assembly removably coupled to the receiver. A gas block is provided mounted to the barrel, the gas block having a passage extending through the gas block in communication with the bore. A direct gas impingement operating system is provided having a gas sleeve located in the passage of the gas block, the gas sleeve in communication through the passage with the bore and a bolt assembly and an impingement cylinder disposed in the bolt carrier and enclosed within the receiver assembly A gas line is provided joined to the sleeve in communication with the bore through the sleeve and the passage, the gas line further in fluid communication with the impingement cylinder. Gas discharged from a fired cartridge displaces the impingement cylinder displacing the bolt assembly. The sleeve has an orifice arranged in the passage, so that it forms a gas flow regulator in the passage regulating gas flow volume from the bore through the passage to the gas line is removable from the gas block without removal of the gas block from the firearm.

In yet another embodiment, a method of removably securing a gas regulating sleeve and a gas line of a gas operating system to an automatic or semi-automatic rifle, the method including the steps of: fluidly coupling a gas block to a bore of a barrel of the rifle; removably locating and securing a gas regulating sleeve in the gas block, the gas regulating sleeve being in fluid communication with the bore of the barrel, a gas line fixed to the sleeve, the gas line being in fluid communication with the bore via the gas regulating sleeve and the gas block, and wherein a portion of the gas line is received within an impingement cylinder of a bolt assembly of the rifle when it is in a first position, and wherein the impingement cylinder moves away from the gas line as it moves from the first position to a second position due to gases passing through the gas line from the gas block; and wherein the gas regulating sleeve and the gas line are removable from the gas block without disconnecting the barrel from the receiver and without removal of the gas block from the barrel.

BRIEF DESCRIPTION OF THE DRAWINGS

The foregoing aspects and other features of the exemplary embodiments are explained in the following description, taken in connection with the accompanying drawings, wherein.

DETAILED DESCRIPTION

Figure 1:
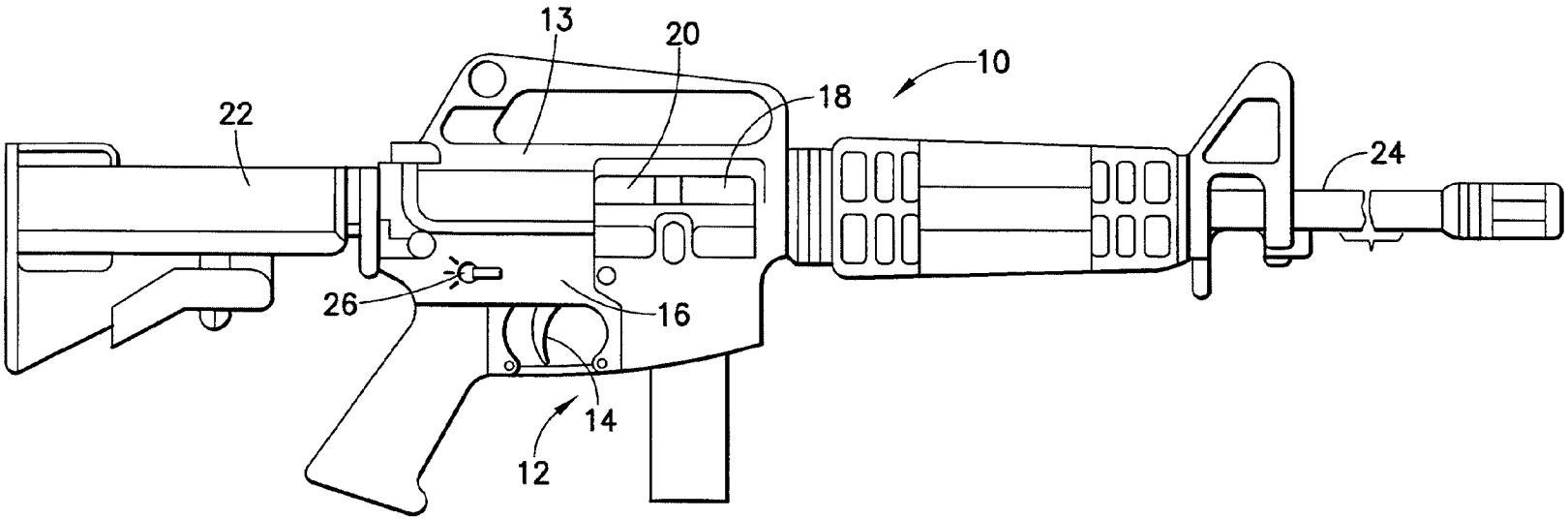
FIG. 1 is a side view of an automatic firearm incorporating features in accordance with an exemplary embodiment.

Referring to FIG. 1, there is shown, a side elevation view of a firearm 10 capable of automatic or semiautomatic fire incorporating features in accordance with an exemplary embodiment of the present invention. Although the present invention will be described with reference to the embodiments shown in the drawings, it should be understood that the present invention can be embodied in many alternate forms of embodiments. In addition, any suitable size, shape or type of elements or materials could be used.

Firearm 10 may be a rifle or carbine with a direct gas impingement operating system, like examples, such as the M-4™ or M-16 rifles available from Colt Defense, LLC, similar commercial variants thereof and may have features as disclosed in U.S. patent application Ser. No. 11/231,063 filed Sep. 19, 2005, U.S. patent application Ser. No. 11/352,036 filed Feb. 9, 2006 or U.S. patent application Ser. No. 60/772,494 filed Feb. 9, 2006 all of which are hereby incorporated herein by reference in their entirety. Firearm 10 is illustrated as generally having a black rifle configuration. The black rifle configuration being the family of rifles developed by Eugene Stoner, for example, such as an M4™ or M16 automatic firearm configuration. However, the features of the disclosed embodiments, as will be described below, are equally applicable to any desired type of automatic firearm. Firearm 10 may have features such as disclosed in U.S. patent application Ser. No. 11/672,189 filed Feb. 7, 2007, and U.S. patent application Ser. No. 11/869,676 filed Oct. 9, 2007, all of which are hereby incorporated by reference herein in their entirety. Firearm 10 may have operational features such as disclosed in U.S. Pat. Nos. 5,726,377, 5,760,328, 4,658,702, 4,433,610, U.S. Non Provisional patent application Ser. No. 10/836,443 filed Apr. 30, 2004, and U.S. Provisional Patent Application 60/564,895 filed Apr. 23, 2004, all of which are hereby incorporated by reference herein in their entirety. The firearm 10 and its sections described in greater detail below is merely exemplary. In alternate embodiments the firearm 10 may have other sections, portions or systems. Firearm 10 may have an upper receiver section 13 a barrel 24, and hand guard portion. The hand guard portion is shown as being separate from receiver 13. In alternate embodiments, the hand guard portion may be integral with upper receiver 13. The hand guard section may have features such as disclosed in U.S. Pat. Nos. 4,663,875 and 4,536,982, both of which are hereby incorporated by reference herein in their entirety. Hand guard section 40 of upper receiver section 34 may be configured to support such rails as a "Picatiny Rail" configuration as described in Military Standard 1913, which is hereby incorporated by reference herein in its entirety. The rails may be made from any suitable material such as hard coat anodized aluminum as an example. A rear sight assembly is provided and mounted to upper receiver section 13. Firearm 10 may incorporate stock 22, lower receiver section 12, magazine well 16, a clip or magazine, rear and front sights, fire control selector 26, trigger 14, bolt assembly 20 and ejection port 18. Upper receiver 13 having barrel 24, lower receiver 12 and magazine well 14 may be modular and configurable such that firearm 10 comprises a modular rifle design. Further, the hand guard, and accessory mounting rails thereon, may be integral with the upper receiver and the integral upper receiver, hand guard and mounting rails may be of unitary construction. In alternate embodiments, the upper receiver and hand guard may be separate.

Figure 2:
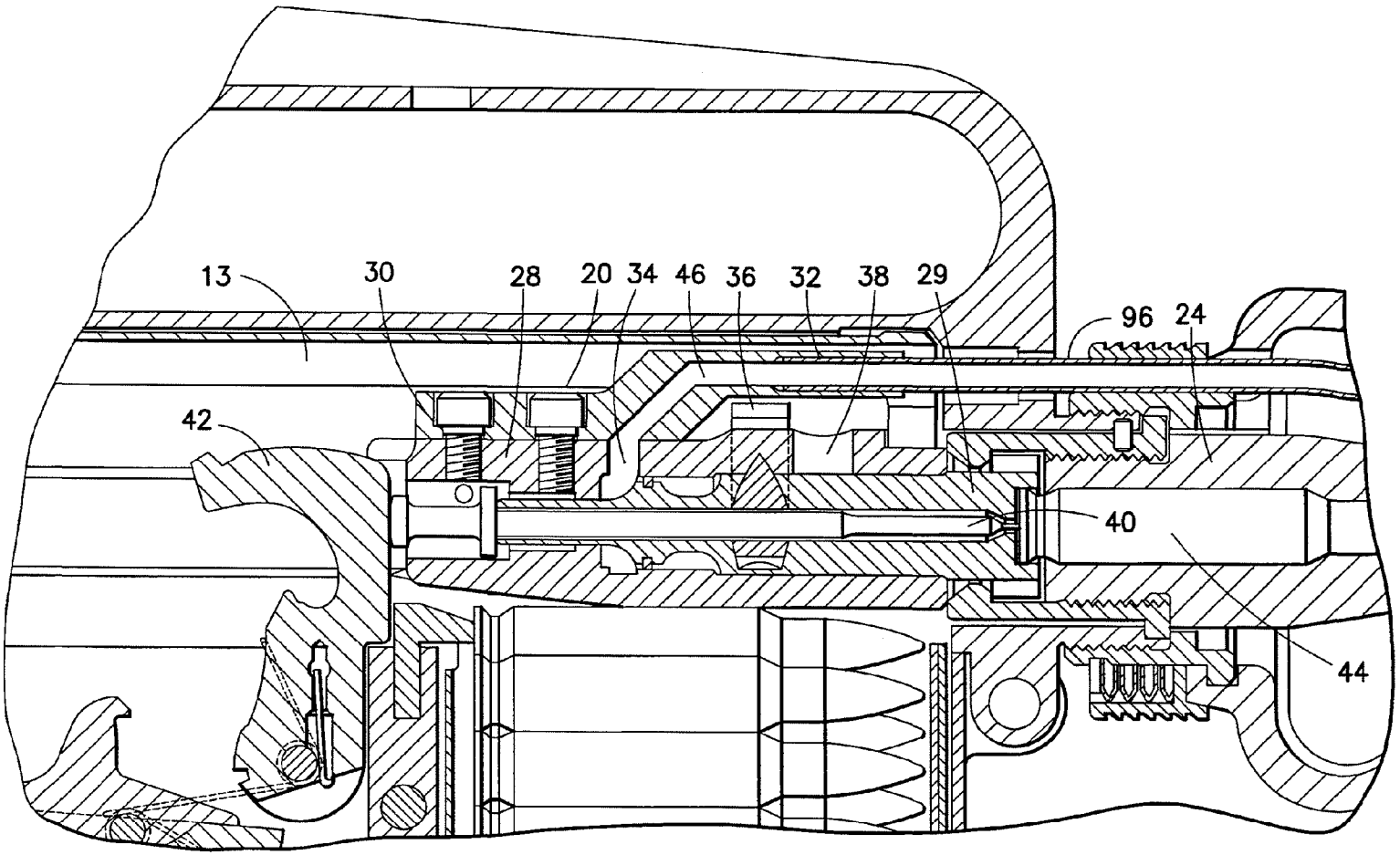
FIG. 2 is a section view of an upper receiver section of the firearm shown in FIG. 1.
Figure 3:
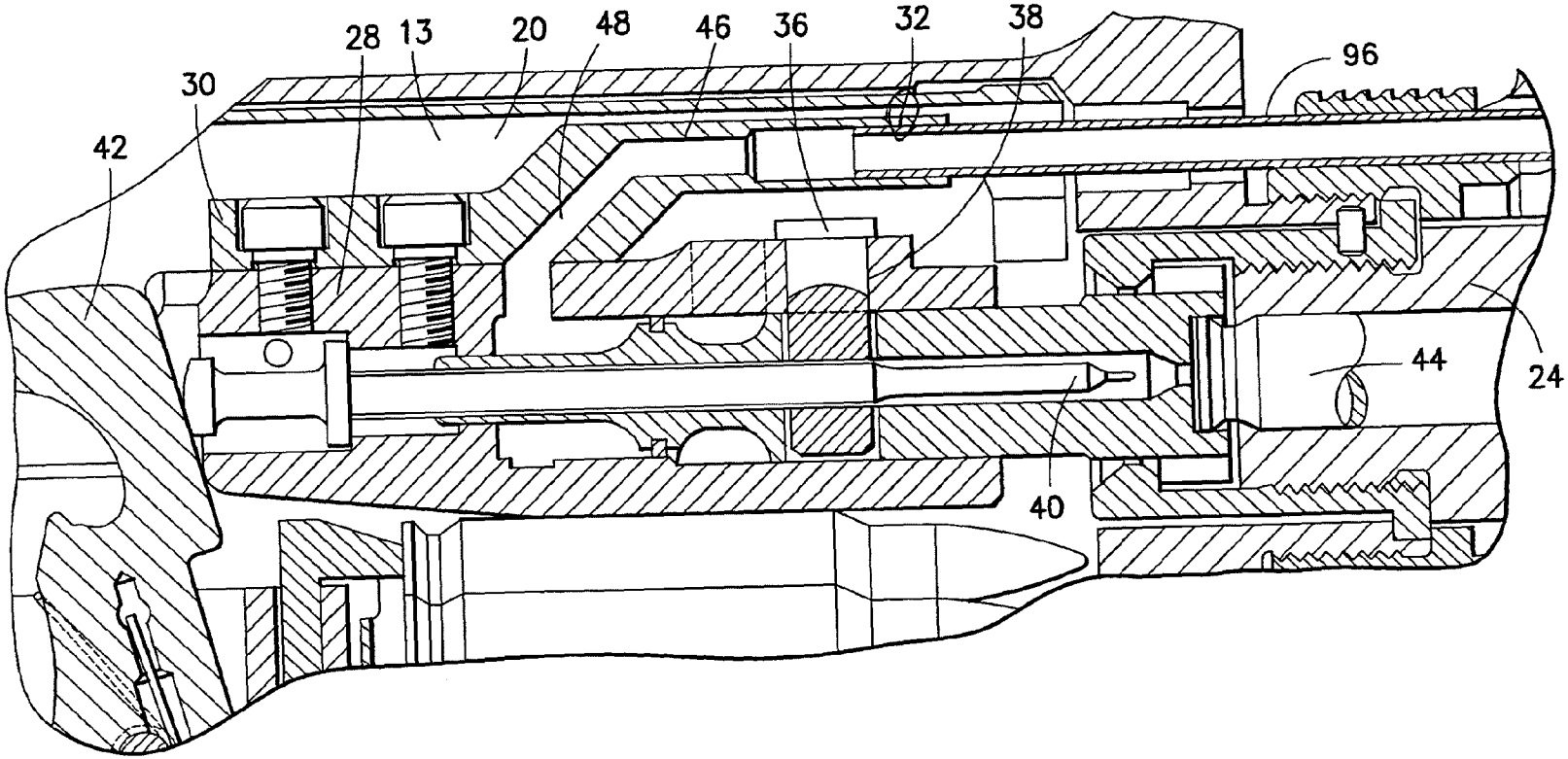
FIG. 3 is a section view of an upper receiver section of the firearm shown in FIG. 1.
Figure 4:
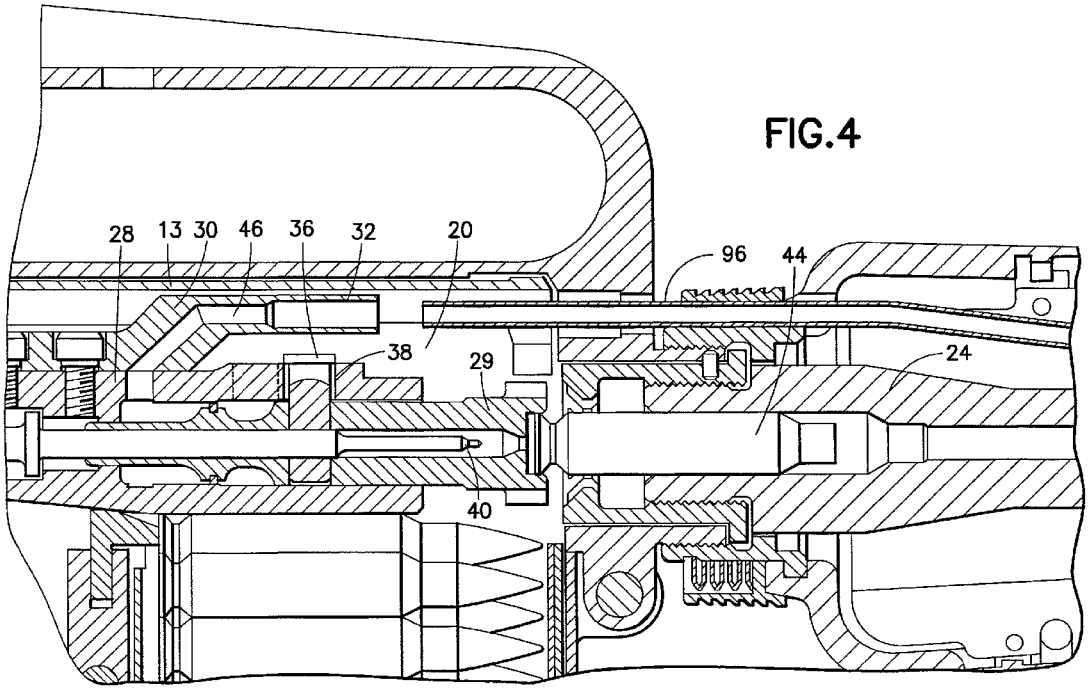
FIG. 4 is a section view of an upper receiver section of the firearm shown in FIG. 1.

Referring now to FIG. 2, there is shown a section view of an upper receiver section of the firearm shown in FIG. 1. Firearm 10 has a direct gas impingement operating system facilitating automatic or semi-automatic operation as will be described below. The direct gas operating system may have a gas feed regulator that may be configured to provide a substantially constant feed flow, independent of variances in barrel exhaust aperture, or may be configured to be adjustable, allowing the operator to vary cyclic rate as desired. As will be described in greater detail below, the system has a gas block assembly mounted or otherwise fitted to the barrel (see FIG. 1) and in fluid communication with the bore of the barrel. The gas block assembly includes a gas block which has a passage formed through the gas block and a sleeve positioned in the passage in communication with the bore. Gas line 96 is provided fitted to the sleeve and also in communication with the bore through the sleeve and the gas block. As can be seen in FIG. 2, gas line 96 is further in fluid communication, via passage in key 30 with impingement cylinder 32 in bolt carrier 28 of bolt assembly 20. As will be described below, the sleeve and the gas line are removable from a front portion of the gas block without removal of the gas block and without removal of the barrel from the receiver assembly. Bolt assembly 20 has bolt carrier 28, within which are located bolt or bolt assembly 29 and firing pin 40 slidably mounted within the bolt 29. The bolt 29 is slidably mounted within the bolt carrier 28. Pin 36 is pressed into the bolt 29 and interfaces with corresponding camming slot 38 of bolt carrier 28. Impingement key 30 has a cylinder portion 32 that slidably engages gas line 96. Port 46 is provided between cylinder portion 32 and the expansion volume 34 of the impingement cylinder between a rear portion of the bolt and the bolt carrier. As can be seen in FIG. 2, hammer 42 strikes firing pin 40 discharging cartridge 44. As can be seen below, gas from discharged cartridge 44 is routed from the barrel, to the gas block and sleeve and to gas line 96. As can be seen in FIG. 3, gas discharged from fired cartridge 44 displaces the impingement cylinder 34 of key 30, displacing bolt carrier 28 as gas expands in the larger expansion volume 48. Camming slot 38 moves toward the rear of the firearm rotating the bolt until pin 36 bottoms out on slot 38. As can be seen in FIG. 4, resulting momentum of bolt carrier 28 in combination with pressure in cylinder 34 also displaces the bolt thus displacing the bolt assembly 20 to eject cartridge 44 and displace hammer 42. Here, impingement cylinder 32 disengages the gas line during operation. A gas regulator may be provided that interfaces with the pressurizing gas in the cylinder to provide a desired gas feed flow independent of variances arising from use of the firearm. The regulator may be incorporated into the gas block assembly or otherwise as will be described in greater detail below. A suitable example of a gas regulator is described in U.S. patent application Ser. No. 11/231,063, filed Sep. 19, 2005, and incorporated by reference herein in its entirety. In alternate embodiments, any suitable gas regulator may be provided.

Figure 5:
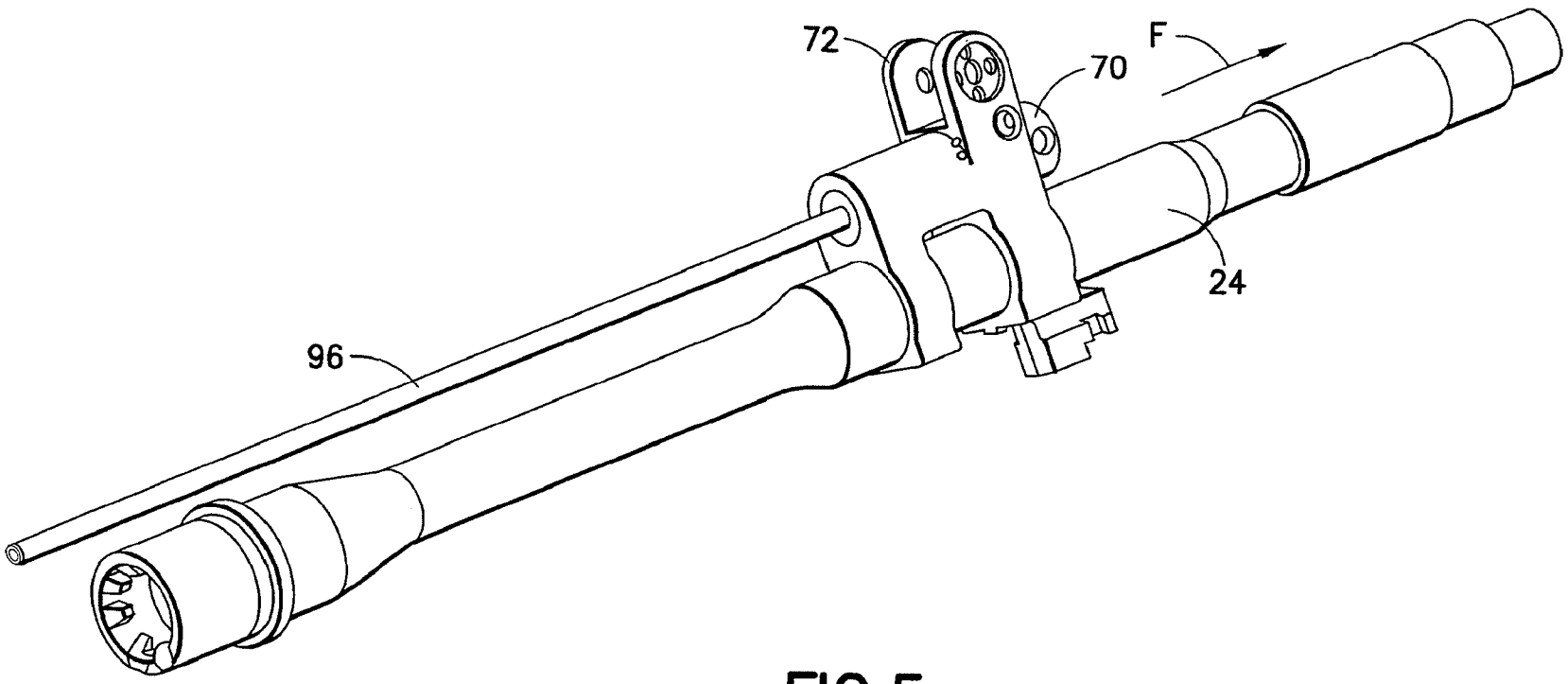
FIG. 5 is an isometric view of a barrel and gas tube assembly.
Figure 6:
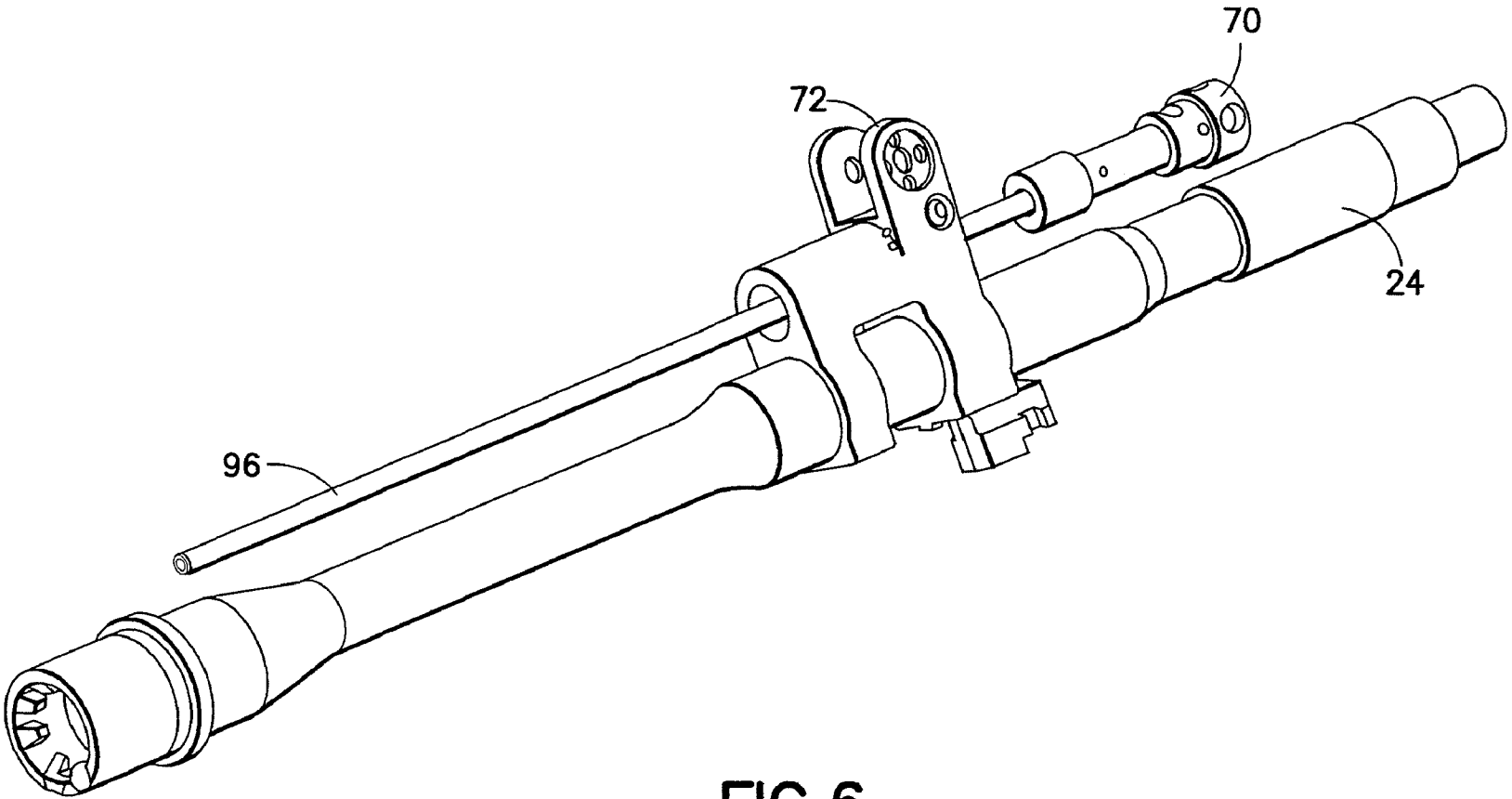
FIG. 6 is an exploded isometric view of a barrel and gas tube assembly.
Figure 7:
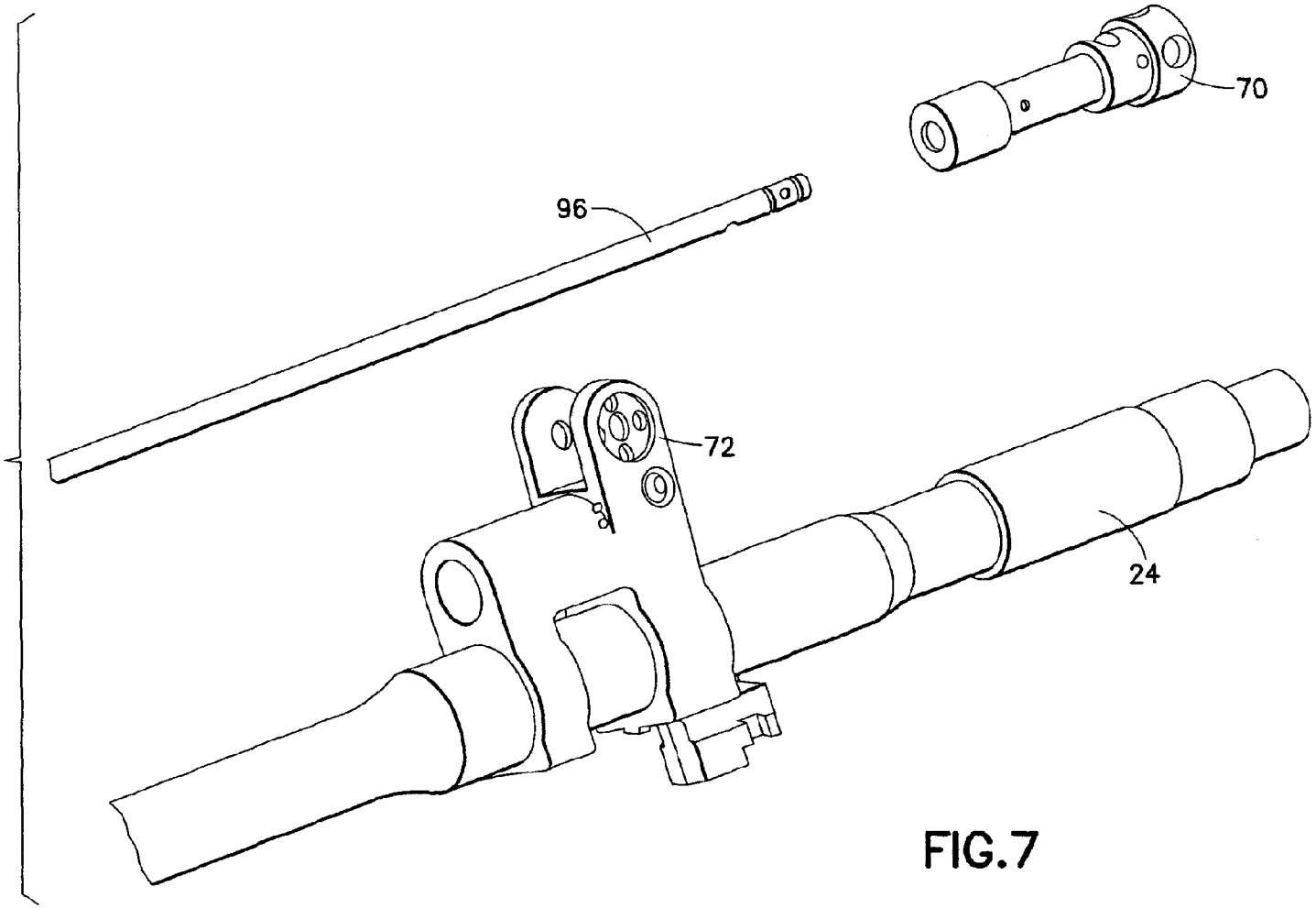
FIG. 7 is an exploded isometric view of a barrel and gas tube assembly.

Referring now to FIG. 5, there is shown an isometric view of a barrel and gas tube assembly. Referring also to FIG. 6, there is shown an exploded isometric view of a barrel and gas tube assembly. Referring also to FIG. 7, there is shown an exploded isometric view of a barrel and gas tube assembly. The direct gas impingement operating system interfaces with gas block 72 fitted to barrel assembly 24 where cylinder 32 of bolt carrier 28 is in fluid communication with gas block 72 via gas tube 96 and removable sleeve 70 (see also FIGS. 6-7). In the exemplary embodiment, the removable sleeve 70 may include the gas regulator and may be removable from the front of gas block 72 (in the direction indicated by arrow F) and therefore removable from the front of the receiver or rail without further disassembly (e.g. without disconnecting barrel from receiver or removable of gas block from barrel). As can be seen in FIGS. 6 and 7, this further enables removal of the gas tube 96 from the firearm as a unit with the gas sleeve without further disassembly. In the exemplary embodiment, removable sleeve 70 is maintained captive with takedown pin 73 (see FIG. 9) allowing for quick removal for reinitiation. A wave spring (not shown) may be provided under the head of sleeve 70 to bias sleeve 70 forward. The take down pin may be held captive. In alternate embodiments, the gas sleeve may be removable or installed in the gas block 72 in any other suitable manner.

Figure 8:
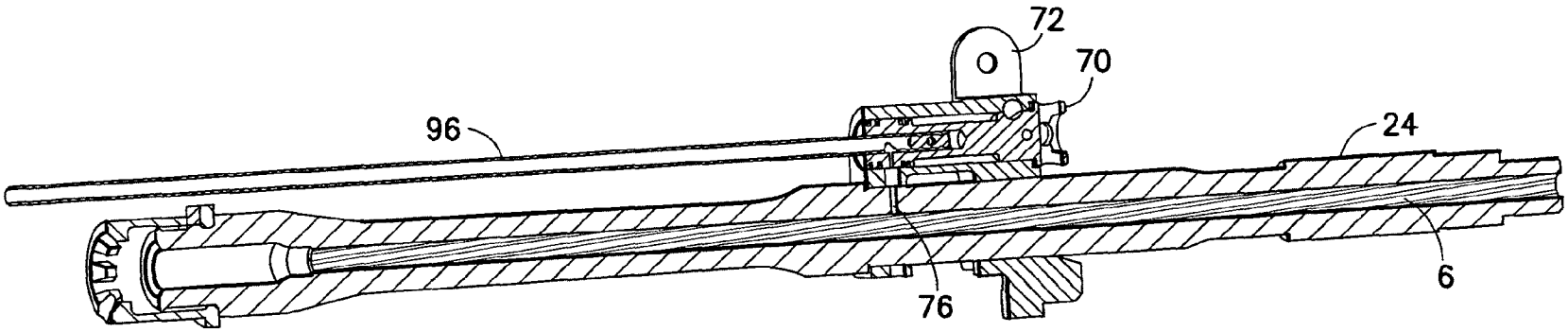
FIG. 8 is a section view of a barrel and gas tube assembly.
Figure 9:
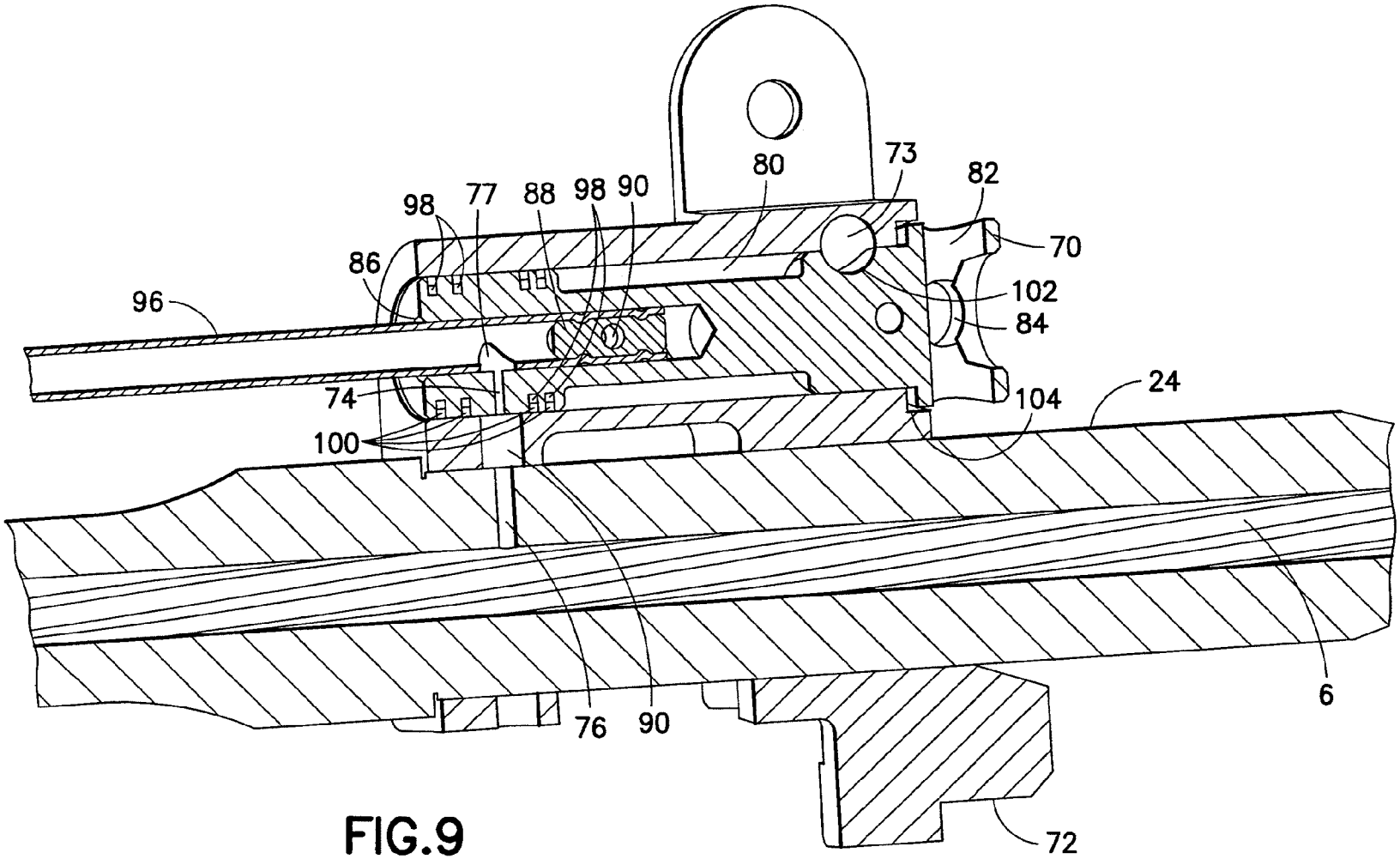
FIG. 9 is a section view of a barrel and gas tube assembly.
Figure 10:
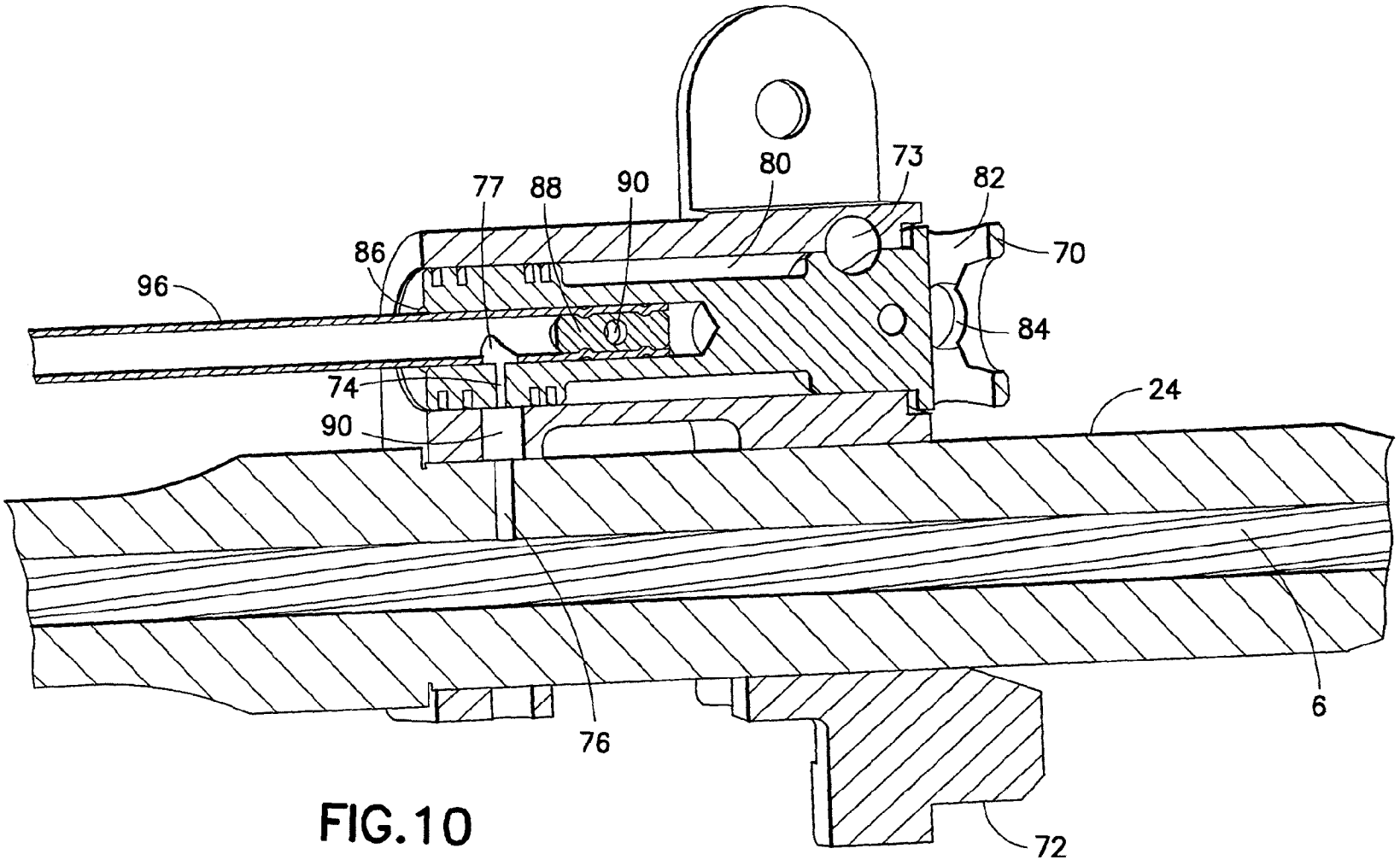
FIG. 10 is a section view of a barrel and gas tube assembly.

Referring now to FIG. 8, there is shown a section view of a barrel and gas tube assembly. Referring also to FIG. 9, there is shown a section view of a barrel and gas tube assembly. Referring also to FIG. 10, there is shown a section view of a barrel and gas tube assembly. The cylinder 32 of the direct gas impingement operating system interfaces with gas block 72 fitted to barrel assembly 24 via gas line 96 and sleeve 70. Barrel 24 has bore 6 with the gas block being in fluid communication with the bore through a port 76 in barrel 24. The gas block 72, may include a passage that extends through the block (as seen best in FIG. 9) and is in fluid communication with the bore through a corresponding port disposed on a surface of the gas block facing the barrel. The sleeve may be located within the passage in the gas block, and may be installed and removed through a front opening of the passage as may be realized from FIG. 6. The sleeve is in fluid communication with the bore through a corresponding port 74 disposed on a surface of the sleeve facing the barrel. As seen in FIG. 10, in the exemplary embodiment the barrel port 76, block port 90 and sleeve port 74, may have different sized openings respectively, arranged so that the gas sleeve port 74 effects gas regulation of feed gases exhausting from the barrel bore 6, via port 70, into the gas line 96 feeding cylinder 32. In the exemplary embodiment, sleeve port 74 is sized and arranged so that changes in either or both the barrel port 76 and gas block port 90 (such as from erosion or fouling) have little perceivable effect on cyclic rate of the firearm. In the exemplary embodiment, gas block 72 is in communication with bore 6 through the first gas port 90 in the gas block and sleeve 70 is in communication with bore 6 through the regulating or second gas port 74 of sleeve 70 inside the passage in the gas block where second gas port 74 is smaller than first gas port 90 and gas port 76. The tube 96 is in fluid communication with the bore through a corresponding port 77, for example disposed on a surface of the tube facing the barrel though such port for the gas tube may be located in any other suitable position in the barrel. Hence, cylinder 32 of bolt carrier 28 is in fluid communication with bore 6 via gas block 72, sleeve 70 and gas tube 96. Tube 96 may have a keyed feature (not shown) that prevents rotation of tube 96 relative to sleeve 70 during operation and alignment of the ports. In alternate embodiments, a recess may be made in the bore of sleeve 70 or housing 72 allowing rotation of tube 96. Holes 82, 84 may be provided on the head of sleeve 70 whereby a tool may be used to rotate sleeve 70 for removal in the event of carbon buildup preventing removal. Chamfer 86 is shown provided on the bore of sleeve 70 to allow for easy assembly and disassembly of rod 96 to sleeve 70. A plug 88 having recesses is provided in tube 96 where the outer surface of tube 96 is formed over the recesses to retain the plug. A hole 90 through tube 96 and plug 88 is shown for proper orientation. In the exemplary embodiment removable sleeve 70 is maintained captive with takedown pin 73 above sleeve 70 engaging slot 102. Slot 102 in the upper portion of sleeve 70 in the upper portion of sleeve 70 provides a cam surface for pin 73 to cam sleeve 70 to seal gas sleeve 70 opening to the gas port in sight block 72. In this manner, pin 73 engages takedown notch 102 such that pressure reacting on sleeve 70 causes pin 73 to cam sleeve 70 down to the exhaust hole and making a tighter seal. Wave spring 104 is provided under the head of sleeve 70 to bias sleeve 70 forward, removing play and actuating the cam surface 102 by lock pin 73. In this manner, the sleeve 70 is coupled to the gas block 72 with removable pin 73, where pin 73 provides a camming surface to seal sleeve 70 to a gas port in gas block 72. The take down pin may be held captive, for example, by a spring and detent ball, or by a pin or otherwise. In alternate embodiments, the sleeve may also have exhaust ports. Relief 80 in the outside diameter of sleeve 70 may facilitate cutting gum or carbon and act as a scrapper and may also be relieved in the back to clear any carbon buildup. In the exemplary embodiment, external annular groove(s) 98 are provided on sleeve 70 for cutting carbon buildup in gas block bore housing cylinder sleeve 70. The annular grooves 98 in the outside diameter of sleeve 70 facilitate cutting gum or carbon that may have impacted on the inside and act as a scraper and may also be relieved in the back to clear any carbon buildup. Grooves 98 may form a labyrinth seal for trapping exhaust blow by and to minimize carbon build up. Although grooves 98 are shown radially cut, in alternate embodiments, grooves 98 may have any suitable shape, for example, grooves 98 may be helically cut. Here, slots or grooves 98 are adapted to remove carbon build up during operation. Grooves 98 may be provided with rings 100, with the rings adapted to enhance sealing of the sleeve to gas block interface (minimizing exhaust blow by through the interface) and may remove carbon build up during operation and removal of sleeve 70 from gas block 72. In the exemplary embodiment, different interchangeable gas sleeves (similar to gas sleeve 70) may be provided, each with different sized gas regulating ports (similar to port 74). The bores of the regulating ports may be varied in size, for example in accordance with different barrel lengths or other predetermined characteristics of the barrel or firearm. The gas sleeves may be selected for installation from the different interchangeable gas sleeves in accordance for example, with barrel length. In alternate embodiments, a gas sleeve may be provided with more than one gas regulating port, each port having a different bore size and resulting in a different gas feed flow when positioned in communication via gas block port 90 with the barrel exhaust port 76.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the exemplary embodiments.

What is claimed is:

1. A method of removably securing a gas regulating sleeve and a gas line of a gas operating system to an automatic or semi-automatic rifle, comprising:

fluidly coupling a gas block to a bore of a barrel of the rifle;

removably locating and securing the gas regulating sleeve in the gas block, the gas regulating sleeve being in fluid communication with the bore of the barrel, a gas line fixed to the sleeve, the gas line being in fluid communication with the bore via the gas regulating sleeve and the gas block, and wherein a portion of the gas line is received within an impingement cylinder of a bolt assembly of the rifle when the bolt assembly is in a first position, and wherein the impingement cylinder moves away from the gas line as it moves from the first position to a second position due to gases passing through the gas line from the gas block and wherein the gas regulating sleeve remains stationary with respect to the gas block as the impingement cylinder moves between the first position and the second position; and wherein the gas regulating sleeve and the gas line are removable from the gas block without disconnecting the barrel from the receiver and without removal of the gas block from the barrel.

2. The method as in claim 1, wherein the gas regulating sleeve is removably coupled to the gas block with a removable pin.

3. The method as in claim 2, wherein the removable pin provides a camming surface to seal the gas regulating sleeve to a gas port in the gas block.

4. The method as in claim 3, wherein the impingement cylinder disengages from the gas line during operation of the rifle.

5. The method as in claim 1, wherein the impingement cylinder disengages from the gas line during operation of the rifle.

6. The method as in claim 1, wherein the gas block is in fluid communication with the bore through a first gas port in the gas block, and wherein the gas regulating sleeve is in fluid communication with the bore of the barrel through a second gas port in the sleeve, and wherein the second gas port is smaller than the first gas port.

7. The method as in claim 1, wherein the gas regulating sleeve is removably coupled to the gas block with a removable pin and wherein the removable pin provides a camming surface to seal the gas regulating sleeve to a gas port in the gas block and wherein the impingement cylinder disengages from the gas line during operation of the rifle and wherein the gas block is in fluid communication with the bore through a first gas port in the gas block, and wherein the gas regulating sleeve is in fluid communication with the bore of the barrel through a second gas port in the sleeve, and wherein the second gas port is smaller than the first gas port.

8. The method as in claim 1, wherein the bolt assembly further comprises a bolt carrier and a key coupled to the bolt carrier, and wherein the bolt carrier contains the impingement cylinder.

9. The method as in claim 1, wherein the impingement cylinder is completely separated from the gas line when the impingement cylinder is in the second position.

10. The method as in claim 9, wherein the gas regulating sleeve is removably coupled to the gas block with a removable pin.

11. The method as in claim 10, wherein the removable pin provides a camming surface to seal the gas regulating sleeve to a gas port in the gas block.

12. The method as in claim 9, wherein the gas block is in fluid communication with the bore through a first gas port in the gas block, and wherein the gas regulating sleeve is in fluid communication with the bore of the barrel through a second gas port in the sleeve, and wherein the second gas port is smaller than the first gas port.

* * * * *